US005957209A

United States Patent [19]

Burleson et al.

[11] Patent Number: 5,957,209

[45] **Date of Patent: *Sep. 28, 1999**

[54] LATCH AND RELEASE TOOL CONNECTOR AND METHOD

[75] Inventors: John D. Burleson, Denton; Joseph A. Henke, Lewisville, both of Tex.

[73] Assignee: Halliburton Energy Services, Inc., Dallas, Tex.

[ * ] Notice: This patent is subject to a terminal disclaimer.

[21] Appl. No.: 09/118,551

[22] Filed: Jul. 17, 1998

Related U.S. Application Data

[63] Continuation of application No. 08/698,608, Aug. 16, 1996, Pat. No. 5,823,266.

[51] Int. Cl.[6] ..... E21B 17/02

[52] U.S. Cl. ..... 166/380; 166/242.6

[58] Field of Search ..... 166/115, 297, 166/344, 302, 381, 55, 242.6, 380; 175/4.56

[56] References Cited

U.S. PATENT DOCUMENTS

| | | | |
|---|---|---|---|
| 3,997,196 | 12/1976 | Karcher . | |
| 4,305,465 | 12/1981 | Ellis | 166/382 |
| 4,436,157 | 3/1984 | Brooks | 166/344 |
| 4,451,069 | 5/1984 | Melone . | |
| 4,790,571 | 12/1988 | Montanari . | |
| 4,806,114 | 2/1989 | Hopper . | |
| 5,273,121 | 12/1993 | Kitney . | |
| 5,398,760 | 3/1995 | George et al. | 166/297 |
| 5,518,072 | 5/1996 | McTernaghan | 166/115 |
| 5,529,127 | 6/1996 | Burleson et al. . | |
| 5,603,379 | 2/1997 | Henke . | |

FOREIGN PATENT DOCUMENTS 2312226 10/1997 United Kingdom .

WO97/27382 7/1997 WIPO .

OTHER PUBLICATIONS

"4.06 Safeconn Deployment BOP System 10,000 PSI Working Pressure," Texas Oil Tools, 24 pgs., Sep. 1994.

"2.25 Safeconn Depolyment Connector," Texas Oil Tools, 7 pgs., Apr. 1996.

"3.06 EM Quad BOP, $H_2S$," Jan. 1996.

*Primary Examiner*—Frank Tsay

*Attorney, Agent, or Firm*—Paul I. Herman; John F. Booth

[57] ABSTRACT

A tool connector is provided for downhole use in oil and gas fields. The tool connector includes a stinger and a stinger receptacle. The stinger is adapted to be stabbed into the stinger receptacle. A loaded engaging member movable between a running position before the stinger is stabbed into the stinger receptacle and a latched position when the stinger is stabbed into the stinger receptacle to latch the stinger and the stinger receptacle together. A release member retains the loaded engaging member in the running position. When the stinger is stabbed into the stinger receptacle and a set force is applied to the stinger and stinger receptacle, the release member releases the loaded engaging member to move to the latched position and latch the stinger and the stinger receptacle together. According to a second aspect of the invention, the tool connector is releasable, further including a releasable stop member to stop the engaging member in the latched position. When the stop member is released, the engaging member moves to a released position such that the stinger and stinger receptacle are separable. According to a third aspect of the invention having particular application to perforating gun sections, a tool connector is provided with an internal explosive transfer system for transferring the detonation signal from one perforating gun, through the perforating gun connector, and to the next perforating gun. In addition, a method of connecting a first tool section to a second tool section is provided.

32 Claims, 7 Drawing Sheets

LATCH AND RELEASE TOOL CONNECTOR AND METHOD

This application is a continuation of application Ser. No. 08/698,608 filed Aug. 16, 1996 now U.S. Pat. No. 5,823,266 issued Oct. 20, 1998.

TECHNICAL FIELD

This invention relates to new assemblies and methods for connecting and releasing tubing sections and other tool sections for downhole use in oil and gas fields. More particularly, this invention relates to new assemblies and methods for connecting and releasing tubing sections and other tool sections that do not require rotating the tool to latch and release the connector.

BACKGROUND OF THE INVENTION

For the purposes of this description, the term "tool section" refers to any tubular member or section intended for downhole use, including, for example, standard pipe joint sections, well packers, and other downhole tools for use in oil and gas wells.

In the past, conventional threaded pin-and-bell connectors have been used to connect tool sections for various downhole applications. For example, after a tool section is positioned and set in a slip assembly at the rig floor of a well (usually with a threaded pin connector at the upper end thereof), a second tool section is picked up and brought into position over the first tool section. As the second tool section (usually with a threaded bell connector at the lower end thereof) is swinging in the blocks of the rig, it must be carefully axially aligned with the first tool section so that it can be set on the pin connector of the first tool section. The second tool section is then rotated to make up the threaded connection.

There are several problems of using threaded pin-and-bell connections. For example, the process of carefully aligning and threading one elongated tool section to the next is time consuming. Skilled oil-field hands need about one to two minutes to make up or break apart typical tool sections using threaded pin-and-bell connectors, which are often about thirty feet long. The step of aligning the second tool section can be particularly difficult in windy conditions, which cause the thirty-foot section to swing in the blocks. If the second tool section is not properly aligned, the threads of the pin-and bell connectors are likely to gall and bind.

As an alternative to conventional threaded pin-and-bell connectors, some tool connectors are activated or released by certain types of rotational movements other than threading. However, it is becoming increasingly common to use tool sections with coil tubing. Coil tubing may be hundreds or thousands of feet long, such that it is extremely difficult or completely impractical to attempt to rotate the coil tubing to operate a latch or release connection. Thus, it would be desirable to provide a latch and release connector for use with tool sections that does not have to be rotated.

In some applications, tool sections and connector assemblies must be able to pass through reduced diameter tubing or other downhole restrictions to reach the location in the casing where the perforation is to be performed. In these applications, the axial cross-section profile of the tool string is particularly important. For example, in the perforation of a five-inch casing, passing through a small bore may be necessary for the tool assemblies, such as two-and-one-half inch or one-and-eleven-sixteenth inch tubing or other passageway. These through-tubing tool assemblies can be characterized as low-profile assemblies because of the restricted passageways through which they must pass to reach the desired downhole perforation location. These low-profile tool assemblies do not have the luxury of design spacing which is present in tool assemblies whose maximum outside dimensions approximate that of the casing that is to be perforated. These small profile or through-tubing tool assemblies present particular problems that are not present in their larger profiled cousins.

Additional problems are encountered in using downhole tool sections through a blowout preventer. The typical drilling well is provided with a blowout preventer ("BOP") at the well head, which is intended to maintain any pressure within the well head and prevent a blowout of the well. A blowout preventer is also used for safety to recomplete an existing well. A blowout can be an extremely hazardous situation if the oil or gas explodes or catches fire. Furthermore, even if the oil or gas does not ignite, allowing such uncontrolled escape is extremely wasteful of a valuable resource and harmful to the environment. In some countries such as the United States, an uncontrolled escape can subject the producer to substantial government fines for the environmental pollution and the costs of environmental clean up. Blowout preventers are well known in the art, and represented, for example, by U.S. Pat. No. 4,416,441 entitled "Blowout Preventer" issued to Denzal W. Van Winkle on Nov. 22, 1983 and by U.S. Pat. No. 4,943,031 entitled "Blowout Preventer" issued to Denzal W. Van Winkle on Jul. 24, 1990, both of which patents are incorporated herein by reference in their entirety.

According to the art, two or more blowout preventers are typically used in a stack at the well head. For example, the rams of a lower blowout preventer are employed as slip rams, which have serrated metal teeth for gripping and holding a section of downhole tubing or other tool. The slip rams are useful as a type of slip assembly for holding a section of downhole tubing or tool section, which can have many additional sections connected to and suspended from the lower end thereof. The rams of a second blowout preventer above the first are employed as sealing rams, having rubber seals adapted to be compressed against the downhole tubing or other tool to form a pressure-tight seal around the tubing or tool.

Having additional blowout preventers in the stack is common. For example, the rams of a third blowout preventer above the sealing BOP can be equipped with shearing blades for cutting a piece of tubing for which the threads have seized onto the next tubing and cannot be normally unthreaded. The rams of a fourth blowout preventer above the rest can be employed as a blind seal, such that the well head can be completely sealed. Thus, a production well usually has at least two blowout preventers at the well head used for controlling the well.

Unfortunately, the use of conventional threaded pin-and-bell connectors through a lubricator above a blowout preventer stack is particularly time consuming. For example, it typically requires about five minutes for skilled oil-field hands to make up tool sections together through a lubricator above a blowout preventer stack. There has been a particular long-felt need for an apparatus and method that would permit much faster connection and release of tool sections through a lubricator and blowout preventer stack. The cost of oil field hands and recovered production time involved in stringing several tool sections together has driven the search for faster apparatuses and methods. Nevertheless, to the knowledge of the inventors there is still a great need for additional improvements and methods.

Of all the downhole tool sections employed in a well, perforating gun sections present some of the most serious difficulties and challenges. Conventional perforating gun sections used in perforating well casings typically include charge carriers designed to support several separate perforating charges within the desired longitudinal spacing and sometimes a desired radial orientation. Examples of various convention perforating gun sections are illustrated in U.S. Pat. No. 5,095,999 issued to Daniel C. Markel on Mar. 17, 1992, the specification of which is incorporated herein in its entirety. In particular, the Markel patent illustrates a conventional enclosed perforating gun section having a plurality of perforating charges mounted on a carrier strip and enclosed and protected within a carrier tube. (See U.S. Pat. No. 5,095,999, Column 5, lines 20–39 and FIG. 5.)

As is well known in the industry, perforating gun sections use perforating shaped explosive charges designed to shape and direct the explosion with great precision along the focal axis. Typically, a perforating shaped charge will shape and direct a liner material to create a uniform circular jet that is highly focused and directed along the focal axis. The focused jet penetrates the casing that lines the well bore and the surrounding geological formation. The detonation of the perforating charges is intended to increase production of the well, which is hoped will result in a substantial increase in production pressure at the well head.

Usually, maximizing the perforations achievable in a single-shot downhole procedure is desirable. For example, it is sometimes desirable to perforate hundreds, even thousands, of linear feet of downhole casing to enhance well production. However, the length of the typical perforating gun section is about thirty feet. Of course, it is possible to achieve increased perforation of the downhole well casing by repeating the procedure of lowering a perforating gun section to perforate the downhole well casing and retrieving the spent perforating gun section until the desired longitudinal portion of the downhole well casing has been perforated. However, the time and expense involved in repeating each such downhole procedure mitigate in favor of perforating the desired portion of the well bore in a single downhole procedure. Thus, if it is desirable to perforate such lengths of the downhole casing, as is frequently desirable, two or more perforating gun sections must be connected together. The assembled string of perforating gun sections is then lowered downhole to perforate the well in a single shot.

Furthermore, connecting perforating gun sections with such conventional threaded pin-and-bell connectors presents special problems and risks. For example, manually rotating the second perforating gun section with a hand wrench is more time consuming than the with the use of power tongs. With a hand wrench, however, the oil-field hands can feel the process of threading the connector and be more sensitive to whether the threads are properly aligned to prevent galling. But while the use of power tongs to rotate a perforating gun section to make up the threaded connection is faster, if it works, the threads of the connection are much more likely to gall because of the speed of rotation and the oil-field hands' inability to feel the threading and make any necessary adjustments in the alignment of the threads.

A galled threaded connector for perforating gun sections presents particular problems and dangers because of the explosives used in the sections. For example, if the threads gall and bind in a threaded pin-and-bell connector between two perforating gun sections, the transmission of the detonating signal between the two sections may not be reliable. Thus, it is usually desirable or necessary to separate the galled connection, and replace the connector and possibly both the perforating gun sections. However, unthreading the galled threads of the connector is sometimes difficult or impossible. Furthermore, cutting or shearing galled perforating gun sections, which contain high explosives, is counter indicated for obvious safety concerns. Thus, a galled threaded connection between perforating gun sections presents a serious problem. In the past, one of the only solutions to the problem of a seriously galled threaded connection has been to raise the two galled perforating gun sections and unthread the lower connection from the remainder of the perforating gun string, to then safely remove and handle the two improperly joined sections. However, this is wasteful of expensive perforating gun section equipment and extremely time consuming.

For these reasons, it can take several minutes to align, set, and manually makeup each threaded connection between the perforating gun sections, and a galled connection can seriously impede the process of perforating a well. Thus, there has been a long-felt need for a better, more reliable, and faster connector for perforating gun sections.

Furthermore, working with perforating gun sections through a stack of blowout preventers presents several additional problems and challenges. This is true even though the pressure at the well head is initially substantially balanced such that the well head can be opened for the insertion of a tool section. For example, after using the perforating gun section to perforate the downhole well bore, it hopefully increases the well production and the production pressure at the well head. Thus, a problem is then presented of how to withdraw the spent perforating gun section through the blowout preventer. The problem is particularly problematic because a spent perforating gun section has itself been thoroughly perforated by the detonation of the perforating shaped charges. For example, the sealing rams of the sealing blowout preventer may have difficulty fully sealing against the warped, twisted, and punctured metal of the perforating gun section. Furthermore, the open holes created in the spent perforating gun section provide multiple conduits for the pressurized fluid in the well beneath the blowout preventers to enter the spent perforating gun section. Thus, the spent perforating gun section provides an undesired conduit through the blowout preventer stack, leaking or spewing the pressurized production.

A prior art method of addressing this problem of how to remove a spent perforating gun section has been to balance the pressure in the well. Balancing the pressure is normally accomplished by pumping the appropriate density of drilling mud into the well head to equalize the pressure below and above the well head. However, this balancing procedure is sometimes called "killing" the well because it inhibits the production and can create other pressure management and technical difficulties. There has been a long-felt need for an apparatus and method for withdrawing the spent perforating gun section through the stack of blowout preventers at the well head without having to even temporarily kill the enhanced well production.

Furthermore, enhancing the well production of a well that has some positive well pressure at the well head is often desirable. In such a case, perforating the downhole casing is still desirable. Of course, working through a blowout preventer stack with an intact perforating gun section before it has been detonated can be accomplished by employing a lubricator above the blowout preventer stack. The perforating gun sections can be made up with the lubricator according to techniques well known to those of skill in the art. However, the use of a lubricator above the blowout preventer further limits the length of the perforating gun sections that can be used to the practical length of the lubricator. A typical lubricator for such applications can accommodate perforating gun sections of up to about 35 feet (11 meters).

Thus, there has been a long-felt need for assemblies and methods capable of more quickly stringing two tools together for firing in a single downhole procedure, thereby reducing the time and expense involved in perforating a well There has been a long-felt need for apparatuses and methods of withdrawing and more quickly separating spent tool sections from a well. In addition, there has been a particular need for apparatuses and methods for connecting and separating tool sections through a blowout preventer stack while maintaining the pressure below the blowout preventer stack.

SUMMARY OF THE INVENTION

According to a first aspect of the invention, assemblies and methods are provided for connecting tool sections for downhole use. According to this first aspect of the invention, a tool connector includes a stinger and a stinger receptacle. The stinger is adapted to be stabbed into the stinger receptacle. A loaded engaging member movable between a running position before the stinger is stabbed into the stinger receptacle and a latched position when the stinger is stabbed into the stinger receptacle to latch the stinger and the stinger receptacle together. A release member retains the loaded engaging member in the running position. When the stinger is stabbed into the stinger receptacle and a set force is applied to the stinger and stinger receptacle, the release member releases the loaded engaging member to move to the latched position and latch the stinger and the stinger receptacle together. Neither the stinger nor the stinger receptacle have to be rotated to make up the connection between the perforating gun sections.

According to a second aspect of the invention, the tool connector is releasable. The tool connector further includes a releasable stop member to stop the engaging member in the latched position. When the stop member is released, the engaging member moves to a released position such that the stinger and stinger receptacle are separable. Thus, the tool sections can also be released without rotating.

According to a third aspect of the invention, a tool connector having particular application to perforating gun sections is provided. According to this aspect, the tool connector is provided with an internal explosive transfer system for transferring the detonation signal from one perforating gun, through the perforating gun connector, and to the next perforating gun. The internal explosive transfer system protects the booster charges to provide additional safety.

These and other aspects, features, and advantages of the present invention will be apparent to those skilled in the art upon reading the following detailed description of preferred embodiments according to the invention.

BRIEF DESCRIPTION OF THE DRAWINGS

The accompanying drawings are incorporated into and form a part of the specification to provide illustrative examples of the present invention. These drawings with the description serve to explain the principles of the invention. The drawings are only for purposes of illustrating preferred and alternate embodiments of how the invention can be made and used. The drawings are not to be construed as limiting the invention to only the illustrated and described examples. Various; advantages and features of the present invention will be apparent from a consideration of the accompanying drawings in which.

DETAILED DESCRIPTION OF PREFERRED EMBODIMENTS

Figure 1:
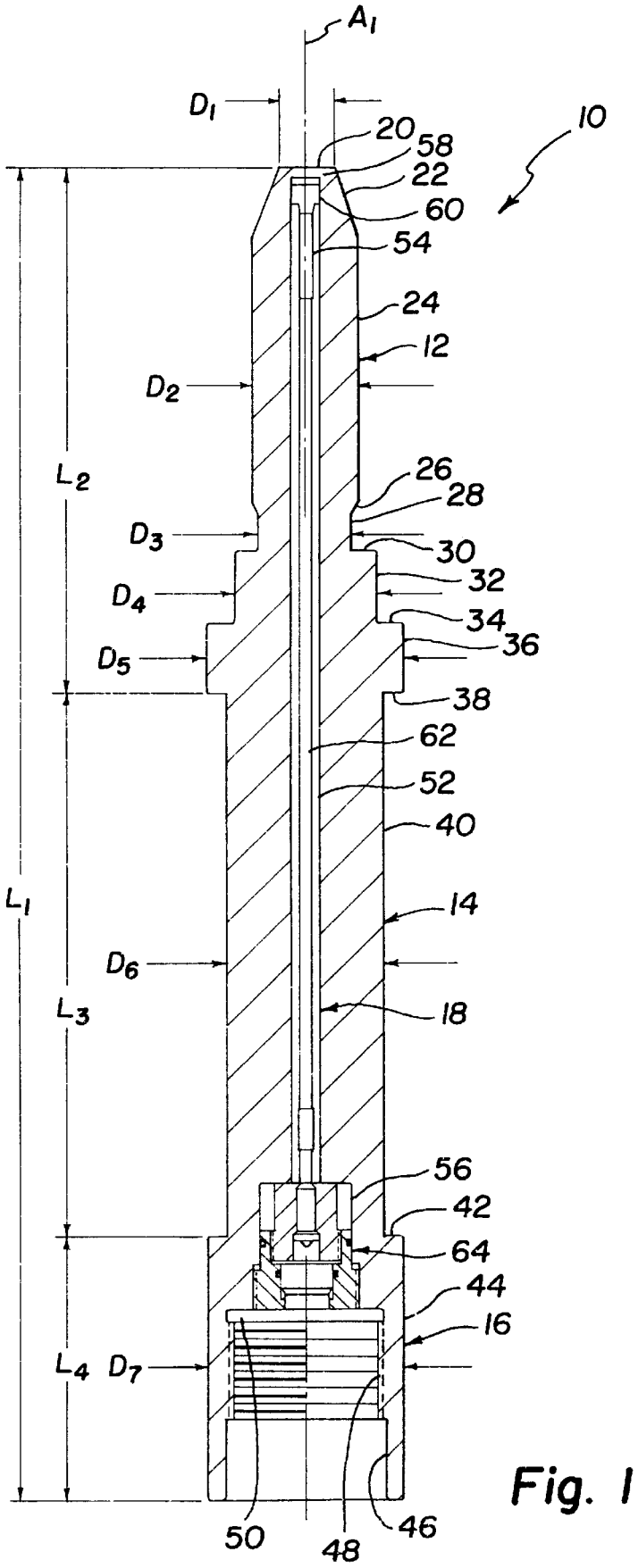
FIG. 1 is an axial cross-section view of the stinger subassembly for a latch and release tool connector according to the presently most preferred embodiment of the invention.

The present invention will be described by referring to drawings of examples of how the invention can be made and used. Like reference characters are used throughout the several figures of the drawing to indicate like or corresponding parts.

The presently most preferred embodiment of the invention is a latch and release connector for use with perforating gun sections, which is one of the most challenging applications for the invention. It is to be understood, however, that the present invention can be employed to connect other types of downhole tools and simple tubing sections.

The structures of the stinger subassembly 10 shown in FIG. 1 will first be described in detail, and then the structures of the latch subassembly 100 shown in FIG. 2. Thereafter, how the structures cooperate and are used to latch perforating gun sections with an ordinary slip assembly and a clamp or through a blowout preventer stack will be described in detail. Regarding the use with a blowout preventer stack, the stack is assumed to have lower seal/slip rams and upper operating rams.

STINGER SUBASSEMBLY

Referring now to FIG. 1, a stinger subassembly 10 according to the presently most preferred embodiment of the invention is shown in an axial cross-section view. In general, the stinger subassembly 10 has a probe portion 12, a slip landing portion 14, a bell connector portion 16, and a stinger internal explosive transfer system 18. According to the presently most preferred embodiment of the invention, the stinger subassembly is generally symmetrical about a stinger central axis $A_1$.

In FIG. 1, the stinger subassembly 10 is shown with its central axis $A_1$ in a vertical orientation and such that the probe portion 12 is oriented upward. This illustrated orientation is how the stinger subassembly 10 would normally be oriented for use at the well head of a well. References to "upward," "downward," "above," "below," and other relative terms are understood to be with reference to the orientation of the stinger subassembly 10 shown in FIG. 1 of the drawing.

The stinger subassembly 10 is adapted to mate with the latch subassembly 100 shown in FIG. 2 of the drawing and as hereinafter described in detail.

Probe Portion of Stinger Subassembly

Referring to FIG. 1, the probe portion 12 of the stinger subassembly 10 preferably has tip 20, a probe first ramp surface 22, a shank surface 24, a probe second ramp surface 26, a probe recess 28, a probe first shoulder surface 30, a probe landing surface 32, a probe second shoulder surface 34, and a centralizer surface 36. Of the stinger overall axial length $L_1$ of the stinger subassembly 10, the probe portion 12 has an axial probe length $L_2$.

According to the presently most preferred embodiment of the invention, the tip 20 presents a flat, circular surface that has a tip diameter $D_1$. From the tip 20, the probe first ramped surface 22 is frusto-conical and expands in diameter downward along the axis $A_1$ from the tip 20 to the shank surface 24. This probe first ramp surface 22 faces upward and helps deflect and guide the probe portion 12 of the stinger subassembly 10 into the latch subassembly 100 as hereinafter described in detail. The shank surface 24 provides a structure for mating with the latch subassembly 100 and has a shank diameter $D_2$.

Below the shank surface 24 is the probe second ramp surface 26, the probe recess 28, and probe first shoulder surface 30. According to the presently most preferred embodiment of the stinger subassembly 10 illustrated in FIG. 1, the probe second ramp surface 26 is preferably frusto-conical and reduces in diameter downward along the axis $A_1$ from the shank surface 24. Thus, this probe second ramp surface 26 faces downward and helps deflect collet fingers of the latch subassembly 100 out of the recess 28 when the collet fingers are moved upward relative to the stinger subassembly 10 as will hereinafter be described in detail. According to the presently most preferred embodiment of the invention, the probe recess 28 is preferably a circumferential recess. Thus, the collet fingers can engage the probe recess 28 regardless of the relative rotational positions of the stinger subassembly 10 and the latch subassembly 100 as hereinafter described in detail. The circumferential probe recess 28 has a recess diameter $D_3$. The probe first shoulder surface 30 faces upwards and defines the lower end of the recess 28.

Below the probe first shoulder surface 30 is the probe landing surface 32 and the probe second shoulder surface 34. According to the presently most preferred embodiment of the stinger subassembly 10 illustrated in FIG. 1, the probe landing surface 32 is cylindrical and adapted to fit within the lower portion of the housing of the latch subassembly 100 as hereinafter described in detail. The cylindrical probe landing surface 32 has a landing diameter $D_4$. The probe second shoulder surface 34 faces upward and serves as a mechanical stop to the further insertion of the probe portion 12 of the stinger subassembly 10 into the housing of the latch subassembly 100 as hereinafter described in detail.

Below the probe second shoulder surface 34 is the centralizer surface 36. According to the presently most preferred embodiment of the stinger subassembly 10 illustrated in FIG. 1, the centralizer surface 36 is cylindrical having a centralizer diameter $D_5$ and is adapted to help centralize the stinger subassembly 10 within the tubulars of a well bore.

Slip Landing Portion of Stinger Subassembly

Continuing to refer to FIG. 1 of the drawing, the slip landing portion 14 of the stinger subassembly 10 is below the centralizer surface 36 of the probe portion 12. The slip landing portion 14 has a slip landing first shoulder surface 38, a slip landing surface 40, and a slip landing second shoulder surface 42. The slip landing portion 14 is preferably integrally formed with the probe portion 12 of the stinger subassembly. Of the overall length $L_1$ of the stinger subassembly, the slip landing portion 14 of the stinger subassembly 10 has an axial landing length $L_3$.

The slip landing first shoulder surface 38 faces downwards and defines the upper end of the slip landing surface 40. The slip landing surface 40 is cylindrical having a slip landing diameter $D_6$ and is structurally adapted to be engaged and held by a slip assembly at the rig floor or the seal/slip rams of a blowout preventer as hereinafter described in detail. The slip second shoulder surface 42 faces upwards and defines the lower end of the slip landing surface 40. The recessed slip landing surface 40 helps indicate a positive engagement of the seal/slip rams of a blowout preventer. However, it is to be understood that the slip landing surface 40 need not be recessed compared with the largest overall diameter of the stinger subassembly 10.

Bell Connector Portion of Stinger Subassembly

Continuing to refer to FIG. 1, the bell connector portion 113 of the stinger subassembly 10 is below the slip second shoulder surface 42 defining the lower end of the slip landing portion 14. The structure of the bell connector portion 16 can be of a standard form to adapt with correspondingly standard pin connectors on perforating gun sections. The bell connector portion 16 is preferably integrally formed with the slip landing portion 14 of the stinger subassembly. Of the overall length $L_1$ of the stinger subassembly, the bell connector portion 16 of the stinger subassembly 10 has an axial bell length $L_4$.

According to the presently most preferred embodiment of the invention, the bell connector portion 16 is a generally tubular body symmetrical about stinger central axis $A_1$ and defining a cylindrical connector surface 44 having a bell diameter $D_7$. The interior of the bell connector portion 16 has a bell sealing area 46, a female threaded bore section 48, and an end seat section 50 formed therein. The interior of the bell connector portion 16 is adapted for receiving and engaging a correspondingly threaded and structured male pin connector. For example, the bell sealing area 46 is adapted to provide a surface for compressing one or more O-ring seals on a correspondingly structured pin connector. The cooperation of the bell sealing area 46 with the corresponding structure and O-ring seals of a corresponding pin connector forms a pressure-tight seal. Thus, the bell connector portion 16 is structurally adapted to be made-up with the correspondingly structured and threaded male pin connector of a perforating gun connector (not shown). The bell diameter $D_7$ is normally also adapted to help centralize the stinger subassembly 10 within the tubulars of a well bore.

Stinger Internal Explosive Transfer System of Stinger Subassembly

Continuing to refer to FIG. 1 of the drawing, the stinger internal explosive transfer system 18 is preferably located centrally within the stinger subassembly 10. According to the presently most preferred embodiment of the invention, the stinger internal explosive transfer system 18 includes a stinger internal chamber 52 that extends from a first end 54 adjacent the tip 20 of the probe portion 12 through the probe portion, through the slip/seal ram landing portion 14, and into the bell connector portion 16 to a second end 56 adjacent the end seat section 50 of the bell connector portion. The first end 54 of the stinger internal chamber 52 is sealed by the web material 58 defining the tip 20 of the probe portion 12. Positioned within the stinger internal tubular chamber 52 adjacent the first end 54 is a stinger booster charge 60. The booster charge is adapted to ignite a stinger detonating cord 62 positioned throughout substantially the entire length of the chamber 52. A stinger initiator section 64 is located at the second end 56 of the stinger internal chamber 52.

Figure 2:
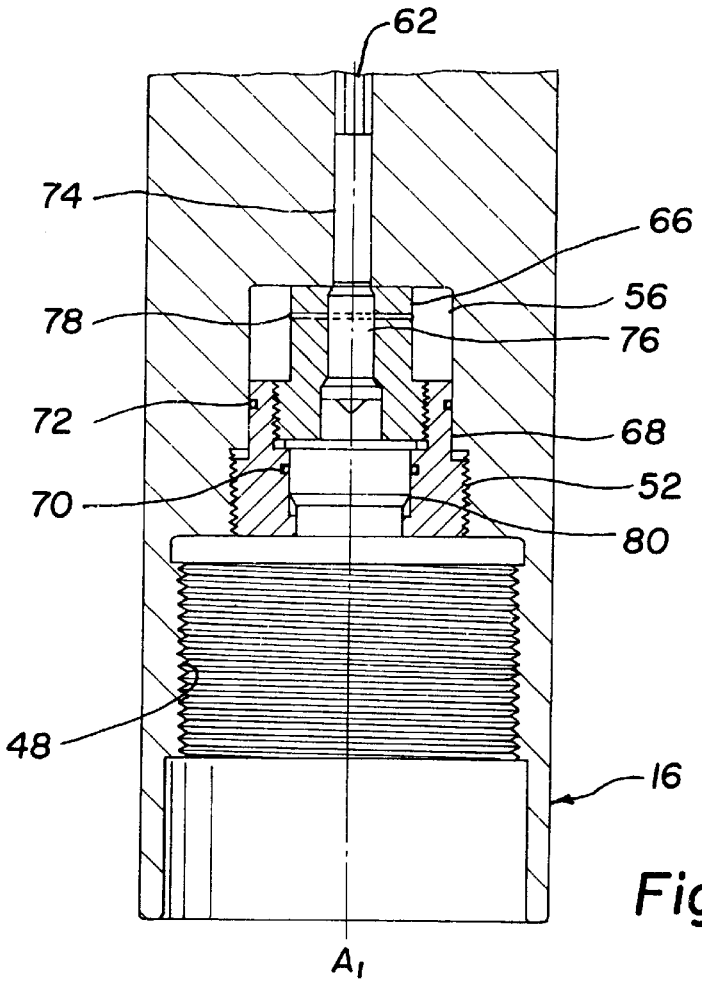
FIG. 2 is an detail cross-section view of part of the internal explosive transfer system of the stinger subassembly according to FIG. 1.

Referring now to FIG. 2 of the drawing, the stinger initiator section 64 of the stinger internal explosive transfer system 18 is shown in more detail. The section 64 is shown adjacent the threads 48 of the bell connector portion 16 of the stinger subassembly. According to the presently most preferred embodiment of the invention, the stinger initiator section 64 includes a firing pin housing 66 with initiator retainer 68 that are threaded into the second end 56 of the stinger internal chamber 52 and sealed with initiator O-ring seals 70 and 72. The end of the detonating cord 62 is provided with an end seal 74 adjacent the firing pin housing 66. A firing pin 76 is mounted within the firing pin housing 66 with shear pins 78. The firing pin 76 is adapted to be fired by the detonating cord 62 toward the stinger initiator 80. According to the invention, the initiator 80 is deformed, but not breached by the firing pin 76, thus, a seal between the interior of the bell connector portion 16 is maintained.

As will hereinafter be described in detail, the stinger internal explosive transfer system 18 is adapted to continue and transfer the detonation of the perforating charges from one perforating gun section, through the stinger subassembly 10, and to the next perforating gun section made-up with the bell connector portion 16 of the stinger subassembly 10. To help with the transfer of the detonation from the stinger subassembly 10 through the bell connector portion 16 to the next perforating gun section made up with the bell connector portion, the interior of the bell connector portion 16 is sealed against well fluids as previously described.

Alternative End Portion and Disposable End Cap for Stinger Subassembly

Figure 3:
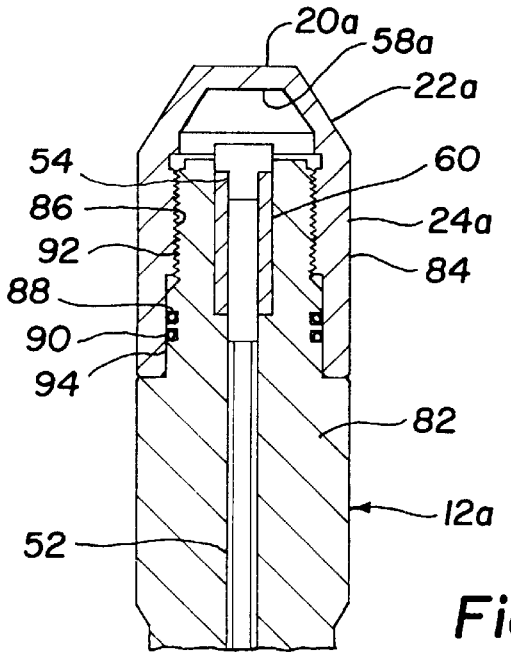
FIG. 3 is a detail cross-section view of an alternative embodiment of the probe portion of the stinger subassembly shown in FIG. 1, wherein the tip is disposable.

Referring to FIG. 3 of the drawing, according to an alternative embodiment of the present invention, an alternative structure is provided for a probe portion 12*a* of a stinger subassembly. The probe portion 12*a* includes an upper end portion 82, which is adapted to receive a disposable end cap 84.

The upper end portion 82 of the probe portion 12 of the stinger subassembly 10 has the first end 54 of the stinger internal chamber 52 formed therein. The stinger receiving initiator charge 60 is positioned within the first end 54 of the stinger internal chamber 52. The upper end portion 82 has male threads 86 formed thereon. Beneath the male threads 86 is formed an O-ring groove 88 adapted to receive and trap a sealing O-ring 90.

The disposable end cap 82 has outer surfaces 20*a*, 22*a*, and 24*a* that substantially conform to the surfaces 20, 22, and 24 previously described for the probe portion 12. The disposable end cap 82 also has an end web portion 58*a* that corresponds to the web portion 58 previously described for the probe portion 12. The body of the end cap 82 has a generally bell-shaped interior with a female threaded portion 92. The female threaded portion 92 of the end cap 82 is adapted to be threaded onto correspondingly male threaded portion 86 formed on the body of the probe portion 12*a*. Below the female threaded portion 92 is an end cap sealing surface 94, which is adapted to seal against the O-ring 90 positioned in the O-ring groove 88 when the end cap is threaded onto the probe portion 12*a*. Thus, the stinger subassembly 10 can be provided with a disposable end cap 82, thereby making the stinger subassembly reusable.

LATCH SUBASSEMBLY

Figure 4:
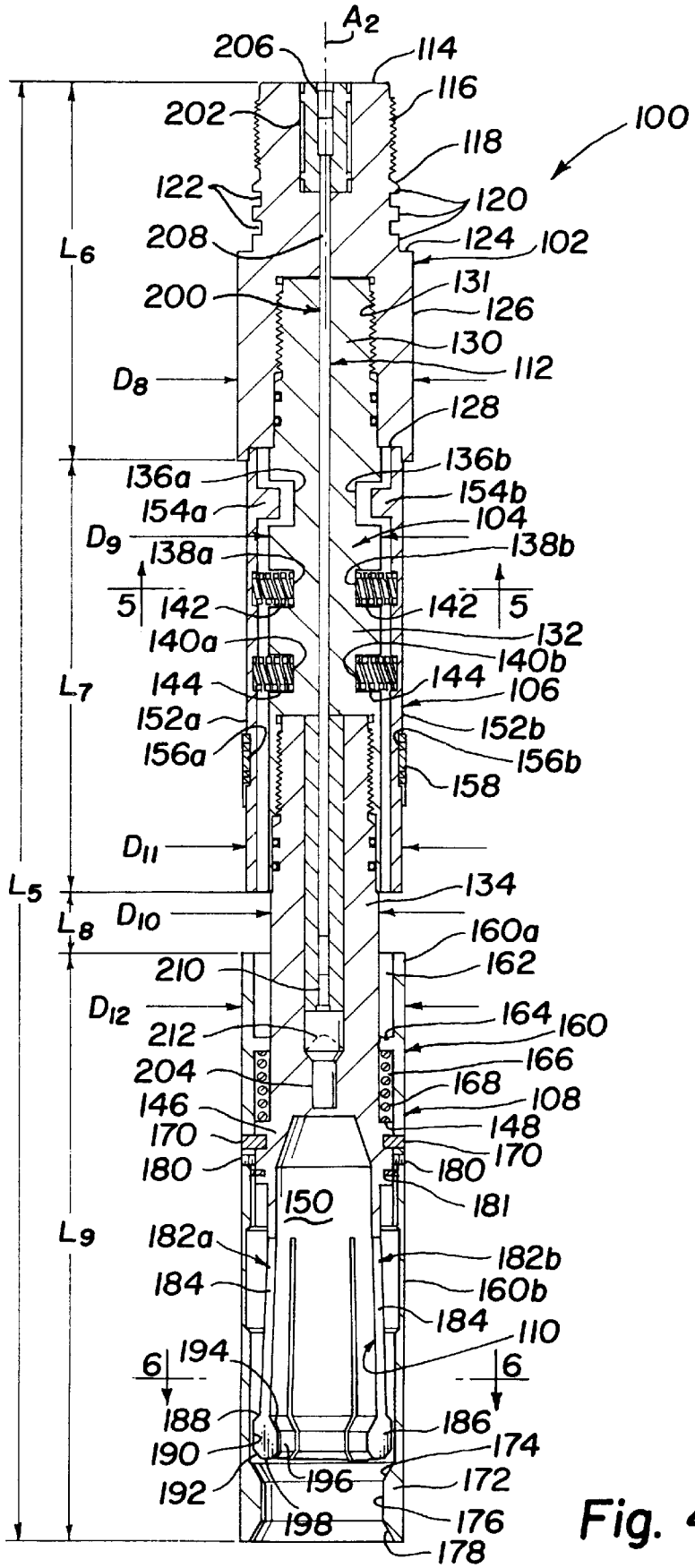
FIG. 4 is an axial cross-section view of the latch and release subassembly for a latch and release tool connector according to the presently most preferred embodiment of the invention.

Referring now to FIG. 4 of the drawing, a latch subassembly 100 according to the presently most preferred embodiment of the invention is shown in an axial cross-section view. In general, the latch subassembly 100 has a pin connector portion 102, a body portion 104, spring-loaded stop/release pads 106, a spring-loaded housing 108, collet fingers 110, and a latch internal explosive transfer system 112. According to the presently most preferred embodiment of the invention, the latch subassembly 100 is generally symmetrical about its central axis $A_2$ except as otherwise noted.

In FIG. 4, the latch subassembly 100 is shown with its central axis $A_2$ in a vertical orientation and such that the housing portion 106 is downward. This orientation is how the latch subassembly 100 would normally be oriented for use at the well head of a well. Again, references to "upward," "downward," "above," "below," and other relative terms are understood to be with reference to the orientation of the latch subassembly 100 shown in FIG. 4 of the drawing.

Pin Connector Portion of Latch Subassembly

Referring now to FIG. 4 of the drawing, the latch subassembly 100 is described and shown in detail. In particular, the pin connector portion 102 is at the upper end of the latch subassembly 100. The structure of the pin connector portion 102 can be of a standard form to adapt with correspondingly standard bell connectors on perforating gun sections. Of the overall length $L_5$ of the latch subassembly 100, the pin connector portion 102 of the latch subassembly has an axial pin length $L_6$.

For the purposes of this description, it will be assumed that a corresponding bell connector portion of a perforating gun assembly (not shown) to be made up with the latch subassembly will have the same structure as the bell connector portion 16 previously described for the stinger subassembly 10. Thus, the pin connector portion 102 is a generally tubular body symmetrical about latch axis $A_2$ and defining an end surface 114, a male threaded pin section 116, a pin ramped surface 118, pin sealing surfaces 120, pin O-ring grooves 122, a pin shoulder surface 124, and a connector centralizer surface 126. The pin connector portion 102 is adapted to be made up with a correspondingly structured and threaded bell connector portion of a perforating gun section. When the pin connector portion 102 and a corresponding bell connector portion of a perforating gun section are moved toward each other, the pin connector portion 102 is guided into the open end section of the bell connector portion. The male threaded pin section 116 is made up with the female threaded section of the corresponding bell connector portion. The pin ramped surface 118 helps guide the pin connector portion 102 into the open end section of the corresponding bell connector portion. The pin O-ring grooves 122 formed in the pin sealing surface 120 are adapted to receive O-rings for helping to seal the pin sealing surface 120 with the bell sealing area of a corresponding bell connector portion of a perforating gun section. The pin sealing surface 120 also helps in aligning the latch central axis $A_2$ of the latch subassembly and its pin connector portion 102 with the corresponding bell connector portion of a perforating gun section. The pin end surface 114 and pin shoulder surface 124 provide mechanical stops against over-tightening the threaded connection between the pin connector portion 102 and a corresponding bell connector portion of a perforating gun section. The connector centralizer surface 126 having a pin diameter $D_8$ is adapted to help centralize the latch subassembly 100 within the tubulars of a well bore.

According to the presently most preferred embodiment of the invention, the lower end of the bell connector portion 102 further has an inwardly facing shelf 128. As will hereinafter be described in detail, this shelf 128 helps in retaining the spring-loaded stop/release pads on the body portion 104.

Body Portion of Latch Subassembly

Continuing to refer to FIG. 4 of the drawing, the body portion 104 of the latch subassembly 100 is a structural member attached to the pin connector portion 102. The body portion 104 has an upper body portion 130 extending into the pin connector portion 102, a central body portion 132, and a lower body portion 134. The upper body portion 130 is for securely mounting the body portion 104 to the pin connector portion 102. As will hereinafter be described in detail, the spring-loaded stop/release pads 106 are connected to the central body portion 132, and the spring-loaded housing 108 and the collet fingers 110 are mounted to the lower body portion 134.

According to the presently most preferred embodiment of the invention, the upper body portion 130 is a structural member in the general form of a cylindrical mandrel or other solid structural member adapted for connecting to the pin connector portion 102 of the latch subassembly 100. The upper body portion has a male threaded section adapted to be threaded into corresponding female threads formed in the pin connector portion 102.

According to the presently most preferred embodiment of the invention, the central body portion 132 is a structural member having a generally cylindrical structure with an overall central body diameter $D_9$. The central body portion 132 is preferably integrally formed with the upper body portion 130. The overall central body diameter $D_9$ is less than the connector centralizer diameter $D_8$ of the pin connector portion 102 to allow the spring-loaded stop/release pads 106 to be mounted to the outside of the central body portion 132. Nevertheless, the spring-loaded stop/release pads 106 still present an overall profile for the latch subassembly 100 that is not greater than the connector centralizer diameter $D_8$. Thus, the latch subassembly 100 can pass through downhole tubing of a desired size.

A plurality of alignment bores are formed in the central body portion 132, such as the illustrated two alignment bores 136*a* and 136*b*. Each of the alignment bores is preferably a cylindrical bore formed in the central body portion 132 and oriented radially about the latch central axis $A_2$. As will hereinafter be described in detail, the alignment bores 136*a–b* are adapted to help maintain the stop/release pads 106 on the central body portion 132. Two additional alignment bores (not shown) are preferably radially oriented 180 degrees from each other and 90 degrees from the alignment bores 136*a* and 136*b*, respectively. Thus, a total of four alignment bores are radially spaced apart 90 degrees about the latch central axis $A_2$. A plurality of spring bores are formed in the central body portion 132, such as the illustrated two upper spring bores 138*a–b* and the two lower spring bores 140*a–b* illustrated in FIG. 4. Each of the spring bores 138*a–b* and 140*a–b* is preferably a cylindrical bore formed in the central body portion 132 and oriented radially about the latch central axis $A_2$. The upper spring bores 138*a–b* are each adapted to receive an upper spiral spring 142 therein, and the lower spring bores 14*a–b* are similarly each adapted to receive a similar spiral spring 144 therein.

The two upper spring bores 138*a* and 138*b* are preferably radially opposed 180 degrees about the latch central axis $A_2$ as shown in FIG. 4. Thus, the upper spiral springs 142 positioned in these two upper spring bores can be loaded to exert opposed radial forces. Two additional upper spring bores (not shown) are preferably radially oriented 180 degrees from each other and 90 degrees from the upper spring bores 138*a* and 138*b*, respectively. Thus, a total of four upper spring bores are radially spaced apart 90 degrees about the latch central axis $A_2$. As will hereinafter be described in detail, each of the four upper spiral springs 142 (only two shown in FIG. 4) mounted in the upper spring bores can be loaded to exert a force opposed to another upper spiral spring 142 mounted in a radially opposed upper spring bore.

Similarly, the two lower spring bores 140*a* and 140*b* are preferably radially opposed 180 degrees about the latch central axis $A_2$ as shown in FIG. 4. Two additional lower spring bores (not shown) are preferably radially oriented 180 degrees from each other and 90 degrees from the lower spring bores 140*a* and 140*b*, respectively. Thus, a total of four lower spring bores are radially spaced apart 90 degrees about the latch central axis $A_2$. As will hereinafter be described in detail, each of the four lower spiral springs 144 (only two shown in the FIG. 4) mounted in the lower spring bores are loaded to exert a force opposed to another lower spiral spring 144 mounted in a radially opposed lower spring bore.

According to the presently most preferred embodiment of the invention, the lower body portion 134 is a structural member having a generally cylindrical structure with a lower body diameter $D_{10}$. The lower body portion 134 is secured to the central body portion 132.

The lower body portion 134 has a collar portion 146, which is preferably integrally formed thereon. The collar portion 146 defines an upwardly facing collar shoulder surface 148. As will hereinafter be described in detail, the collar shoulder surface 148 helps in mounting the spring-loaded housing 108 to the lower body portion 134. Furthermore, the collar portion 146 provides added structural material for helping in connecting the spring-loaded housing 108 thereto.

The bottom end of the lower body portion 134 defines a generally bell-shaped opening 150. As will hereinafter be described in detail, the bell-shaped opening 150 is adapted to receive the probe tip 20 and the probe first ramped surface 22 of the probe portion 12 of the stinger subassembly 10.

Further according to the presently most preferred embodiment of the invention, the bottom end of the lower body portion 134 adjacent the bell-shaped opening 150 has the collet fingers 110 connected thereto.

The lower body diameter $D_{10}$ is preferably substantially the same as the overall central body diameter $D_9$ for central body portion 132. The lower body diameter $D_{10}$ of the lower body portion 134 is less than the connector centralizer diameter $D_8$ of the pin connector portion 102 to allow the spring-loaded housing 108 to be mounted to the outside of the lower body portion 134. Nevertheless, the spring-loaded housing still presents an overall profile for the latch subassembly 100 that is not greater than the connector centralizer diameter $D_8$. Thus, the latch subassembly 100 can pass through downhole tubing of a desired size. Similarly, the diameter of the collar portion 146, although greater than the lower body diameter $D_{10}$, is still less than the connector centralizer diameter $D_8$ of the pin connector portion 102. This smaller diameter allows the spring-loaded housing 108 to be mounted to the outside of the lower body portion 134 yet still present an overall profile for the latch subassembly 100 that is not greater than the connector centralizer $D_8$. Thus, the latch subassembly 100 can pass through downhole tubing of a desired size.

Spring-Loaded Stop/Release Pads of Latch Subassembly

Figure 5:
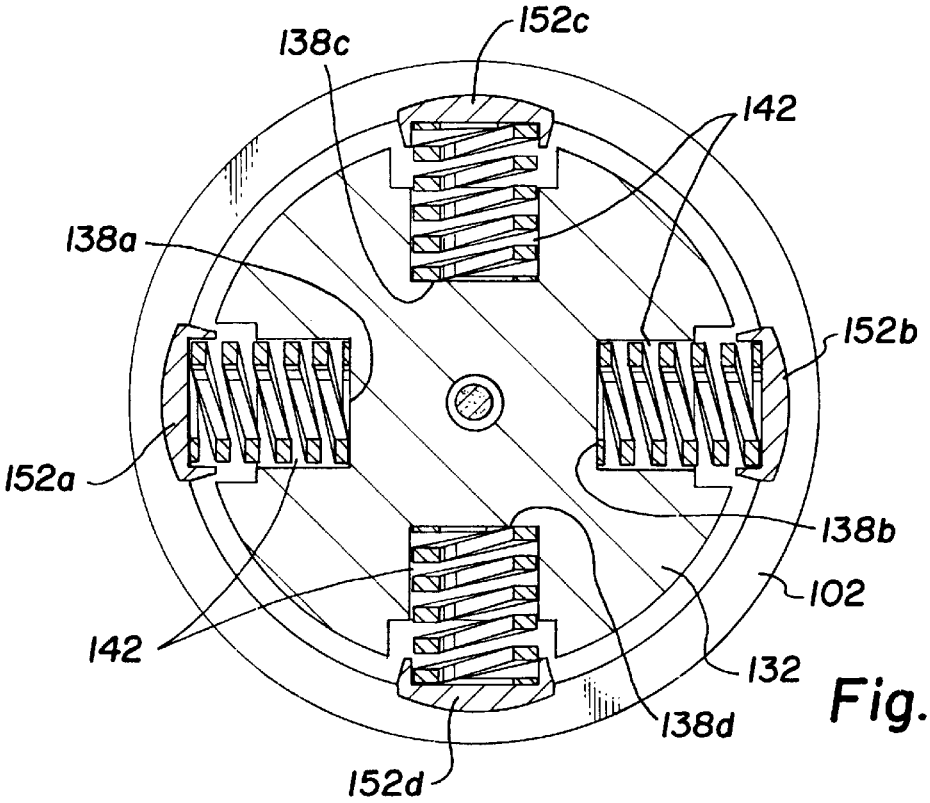
FIG. 5 is a horizontal cross-section view through the line 5—5 of FIG. 4 showing the spring-loaded stop/release pads in more detail.

Referring now to FIGS. 4 and 5 of the drawing, the spring-loaded stop/release pads 106 are mounted to the central body portion 132. Of the overall length $L_5$ of the latch subassembly 100, the spring-loaded stop/release pads 106 have an axial pads length $L_7$.

According to the presently most preferred embodiment of the invention, the structure of the spring-loaded stop/release pads 106 is based on a tubular structure divided into four identical portions, as represented in the drawing by the two pads 152*a* and 152*b* shown in FIG. 4. All four of the pads 152*a–d* are shown in FIG. 5. Together, the four pads of the spring-loaded stop/release pads 106 present an overall pads diameter $D_{11}$. The overall pads diameter $D_{11}$ of the spring-loaded stop/release pads 106 is not greater than the connector centralizer diameter $D_8$ of the pin connector portion 102. Thus, the latch subassembly 100 can pass through downhole tubing of a desired size. As best shown in FIG. 5, the four pads 152*a–d* are positioned on the central body portion 132 over the radially oriented springs, such as upper springs 142. Thus, the springs 142 exert radially outward forces on the pads 152*a–d*.

The upper end of each of the pads, as shown in FIG. 4 for the two pads 152*a* and 152*b*, also includes a peg 154*a* and 154*b*, respectively, adapted to fit within any of the four alignment bores, such as illustrated in FIG. 4 for the alignment bores 136*a* and 136*b*. Thus, the pegs help in retaining the vertical position of the pads on the central body portion 132.

Further according to the presently most preferred embodiment of the invention, the upper end of each of the pads, as shown in FIG. 4 for the two pads 152*a* and 152*b*, extend into the shelf 128 of the pin connector portion 102. This helps in retaining the pads against the springs 142 and 144. As shown in FIG. 4, in the lower end of each of the pads, as shown for the pads 152*a* and 152*b*, is formed a shallow recess 156*a* and 156*b*, respectively. The shallow recesses are identically positioned on each of the pads such that when the four pads are positioned about the central body portion 132, the recesses define an at least partially circumferential recess. Thus, the recesses are adapted to position a tubular collar 158 over the lower end of the pads 152*a–d*. The cooperation of the shallow recesses with the tubular collar 158 retains the four pads, represented by pads 152*a* and 152*b*, against the upper springs 142 and lower springs 144. Thereby, the four pads are spring-loaded to the central body portion 132.

To assemble the spring-loaded stop/release pads onto the central body portion 132, the body portion 104 is separated from the bell connector portion 102. The plurality of upper springs 142 are positioned in the upper spring bores 138*a–d* of the central body portion 132 as shown in FIGS. 4 and 5, and the plurality of lower springs 144 are positioned in the lower spring bores of central body portion, as shown in FIG. 4 for lower spring bores 140*a–b*. The pads 152*a–d* are then positioned over the central body portion 132, such that the peg 154 of each pad is positioned in one of the alignment bores, as shown in FIG. 4 for alignment bores 136*a–b*. The tubular collar 158 is positioned over the pads as shown in FIG. 4 to restrain them against the upper springs 142 and lower springs 144. The upper body portion 130 of the body portion 104 is then secured to the bell connector portion 102 such that the upper ends of the pads are restrained against the upper springs 142 and lower springs 144 as shown in FIG. 4.

Spring-Loaded Housing of Latch Subassembly

Continuing to refer to FIG. 4 of the drawing, the spring-loaded housing 108 is mounted on the lower body portion 134. The overall housing diameter $D_{12}$ of the spring-loaded housing 108 is not greater than the pin centralizer diameter $D_8$, whereby the latch subassembly 100 can pass through downhole tubing of a desired size. When the spring-loaded housing 108 is set and ready for use as illustrated in FIG. 4 of the drawing, the housing 108 is spaced apart from the lower end of the spring-loaded stop/release pads 106 by an axial spacing length $L_8$. As will hereinafter be described in detail, however, the spring-loaded housing 108 is adapted to be axially moved upward on the lower body portion 134, first to close the axial spacing length $L_8$, and then to overlap with the lower end of the spring-loaded stop/release pads 106. Of the overall length $L_5$ of the latch subassembly 100 when it is in the set position shown of FIG. 4, the spring-loaded housing 108 has an axial length $L_9$.

According to the presently most preferred embodiment of the invention, the spring-loaded housing 108 includes a substantially tubular housing member 160 adapted to slide over the lower body portion 134. As will hereinafter be described in more detail, the tubular housing member 160 is preferably formed in two sections, an upper housing portion 160*a* and a lower housing portion 160*b*. The tubular housing member 160 has an inner diameter that is larger than the lower body diameter $D_{10}$ of the lower body portion 134, but adapted to slide over the collar portion 146 of the lower body portion 134. Thus, there is a first annular space 162 defined between the lower body diameter $D_{10}$ of the lower body portion 134 and the inner diameter of the tubular housing member 160 of the spring-loaded housing 108. The upper end of the first annular space 162 is open. The tubular member 160 has an inwardly facing flange 164 that can slide with the tubular member 160 along the lower body portion 134 and defines the lower end of the first annular space 162. As will hereinafter be described in detail, the first annular space 162 is adapted to move over the lower ends of the four pads 152*a–d* when the pads are radially compressed against the springs 142 and 144 such that the pads 152*a–d* present a smaller diameter profile.

The flange 164 defines the upper end of a second annular space 166. The lower end of the second annular space 166 is defined by the upwardly facing collar shoulder surface 148 on the collar portion 146 of the lower body portion 134. The housing spring 168, which is trapped at its lower end by the upwardly facing collar shoulder surface 148 of the collar portion 146, exerts an upward force against the flange 164 of the tubular housing member 160. This upward force exerted by the spring 168 is parallel to the latch central axis $A_2$.

One or more retaining pins, such as screws 170 are tapped or threaded through the tubular housing member 160 and into the collar portion 146 of the lower body portion 134. Thus, the retaining screws 170 retain the tubular housing member over the lower body portion 134 against the force of the housing spring 168 positioned within the second annular space 166.

The lower end of the tubular housing member 160 has an inwardly facing deflecting structure 172, which is for engaging the collet fingers 110 with the stinger subassembly 10 as will hereinafter be described in detail. According to the presently most preferred embodiment of the invention, the deflecting structure 172 has a deflecting first ramped surface 174, an engaging surface 176, and a deflecting second ramped surface 178. The deflecting first ramped surface 174 is frusto-conical and reduces in diameter downward along the axis $A_2$ of the latch subassembly 100. The engaging surface 176 defines an inner cylindrical wall below the deflecting first ramped surface 174. The deflecting second ramped surface 178 is frusto-conical and expands in diameter downward along the axis $A_2$ of the latch subassembly 100.

As previously mentioned, according to the presently most preferred embodiment of the invention, the tubular housing member 160 is preferably formed into two portions, upper housing portion 160*a* and lower housing portion 160*b*. The upper housing portion 160*a* and the lower housing portion 160*b* are threaded together and retained with one or more set screws 180. This separable housing structure permits the latch assembly 100 to be more easily assembled. For example, the lower body portion 134 is removed from the central body portion 132, so that the upper housing portion 160*a* can be placed over the lower body portion 134 from its upper end. Otherwise, if the lower housing portion 160*b* were integrally formed with the upper housing portion 160*a*, the deflecting structure 172 would not slide over the diameter of the collar portion 146 on the lower body portion 134.

Finally, according to the presently most preferred embodiment of the invention, a housing snap-ring seal 181 is provided between the lower body portion 134 and the tubular housing member 160 to prevent the housing from moving downward and accidentally releasing while running into and out of the well. The snap-ring 181 expands beyond the inside diameter of the pin threads on housing 160*a*.

To assemble the spring-loaded housing 108 onto the lower body portion 134, the lower body portion 134 is separated from the central body portion 132. The housing spring 168 is positioned over the lower body portion 132 and slid downward until it is stopped by the upwardly facing collar shoulder surface 148 on the collar portion 146 of the lower body portion 134. The upper housing portion 160*a* is then positioned over the lower body portion 132 and slid downward such that the inwardly facing flange 164 compresses the spring 168 as shown in FIG. 4. The one or more retaining screws 170 are tapped or threaded through the tubular housing member 160 and into the collar portion 146 of the lower body portion 134. Thus, the retaining screws 170 retain the tubular housing member over the lower body portion 134 against the force of the housing spring 168 positioned within the second annular space 166. The lower housing portion 160*b* is slid upward from the lowermost end of the lower body portion 134. Then the lower housing portion 160*b* is threaded to the upper housing portion 160*a* and retained with one or more set screws 180.

Collet Fingers of Latch Subassembly

Figure 6:
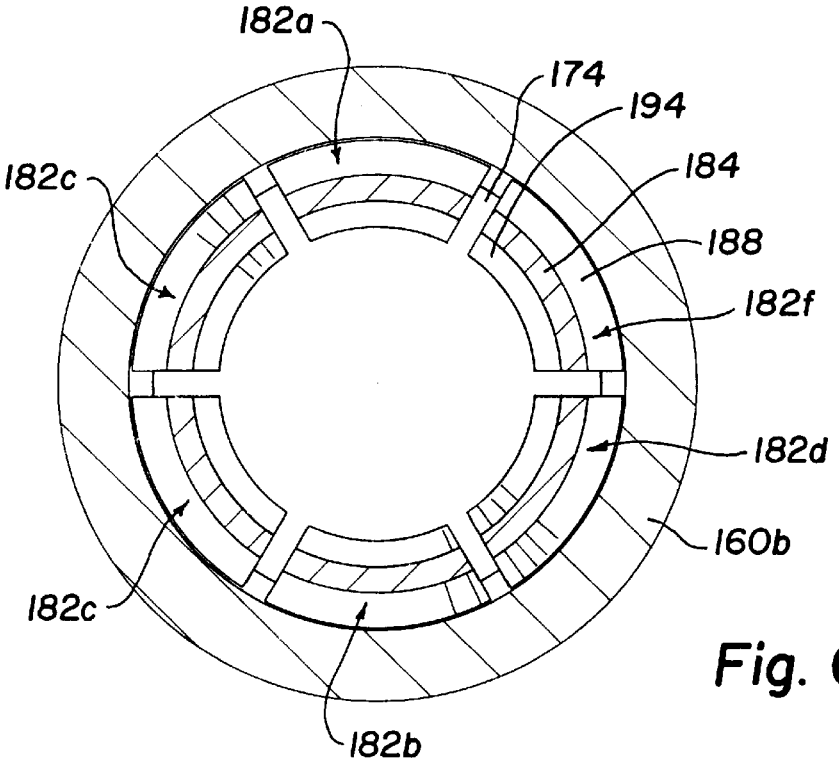
FIG. 6 is a horizontal cross-section view through the line 6—6 of FIG. 4 showing the collet fingers in more detail.

Continuing to refer to FIG. 4 of the drawing, the collet fingers 110 of the latch subassembly 100 are attached to the lower body portion 134. At least two collet fingers 110, such as the first and second collet fingers 182*a* and 182*b* are employed. However, it is to be understood that additional collet fingers can be used, which may be particularly desirable for a larger latch subassembly for use in larger downhole tubing applications. The arcuate extension of each of the collet fingers 182*a* and 182*b* is a matter of design choice, and is expected to range up to nearly 90 degrees of radial arc about the latch axis $A_2$. Thus, if desired, four or more collet fingers 110 can be employed in the latch subassembly 100. According to the presently most preferred embodiment, as shown in FIG. 6 of the drawing of the invention, six collet fingers 182*a–f* are employed. Referring back to FIG. 4 of the drawing, each of the individual collet fingers, as represented by collet fingers 182*a* and 182*b*, has a dog portion 184 and a finger tip portion 186.

The upper end of the dog portion 184 of each collet finger 182*a–b* is an extension of the lower body portion 134. The dog portion 184 is adapted to be sufficiently deformable to be deflected inward or outward relative to the relaxed position shown in FIG. 4 of the drawing. Alternatively, the dog portion 184 of each collet finger 182*a–b* can be pivotally mounted to the lower body portion 134 adjacent the bottom of the bell-shaped opening 150.

According to the presently most preferred embodiment of the invention, the finger tip portion 186 of each of the collet fingers 182*a–b* has a plurality of surfaces adapted to be deflected by and engage with other surfaces of the stinger subassembly 10 and the latch subassembly 100. In particular, the finger tip portion of each of the collet fingers 182*a–b* has a first outwardly facing ramped surface 188, an outwardly facing vertical surface 190, a second outwardly facing ramped surface 192, a first inwardly facing ramped surface 194, an inwardly facing vertical surface 196, and a second inwardly facing ramped surface 198. The cooperation of these surfaces 188–198 with other surfaces and structures will hereinafter be described in more detail.

Latch Internal Explosive Transfer System

Continuing to refer to FIG. 4 of the drawing, the latch internal explosive transfer system 112 is preferably located centrally within the latch subassembly 100. According to the presently most preferred embodiment of the invention, the latch internal explosive transfer system 112 includes a latch internal chamber 200. The chamber 200 extends from a first end 202 adjacent the end surface 114 of the pin connector portion 102 and through the entire body portion 104 to a second end 204 adjacent the bell-shaped opening 150 of the lower body portion 134. Positioned within the latch internal chamber 200 adjacent the first end 202 is a latch receiving booster charge 206. A latch detonating cord 208 is positioned through substantially the entire length of the chamber 200. A latch booster charge 210 and a downward focused shaped charge 212 are positioned in the chamber 200 adjacent the second end 204 of the chamber 200. As will hereinafter be described in detail, the latch internal explosive transfer system 112 is adapted to continue and transfer the detonation of the perforating charges from one perforating gun section made-up with the pin connector portion 102 of the latch subassembly 100, through the latch subassembly 100, and to a stinger subassembly 10 latched to the latch subassembly 100. As previously mentioned, the stinger subassembly 10 in turn continues and transfers the detonation to the next perforating gun section made-up with the bell connector portion 16 of the stinger subassembly 10.

Method of Using Latch and Release Perforating Gun Connector

Figure 7:
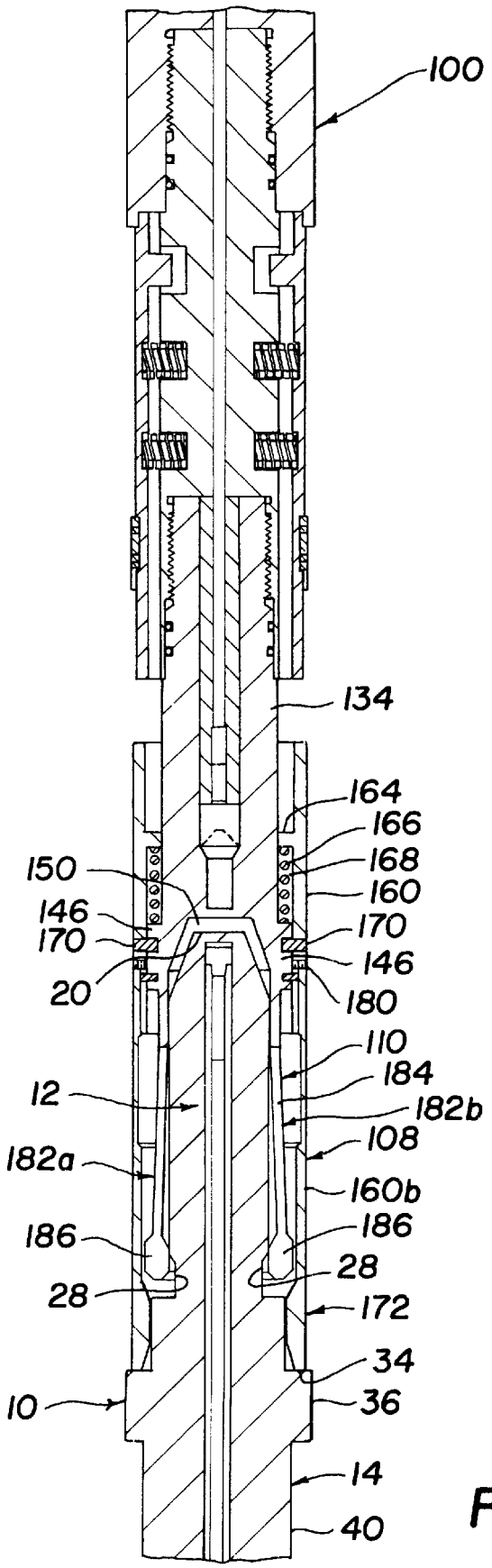
FIG. 7 is an axial cross-section view showing the latch and release subassembly according to FIG. 4 in a running position for engaging the stinger subassembly according to FIG. 1.

Referring now to FIG. 7 of the drawing, the stinger subassembly 10 is shown as it is positioned when the slip landing surface 40 of the slip landing portion 14 are held by the seal/slip rams of a blowout preventer (not shown). For the purposes of this description, the stinger subassembly 10 has already been made up with a lower perforating gun section (not shown), which has been inserted through the blowout preventer seal/slip rams. The latch subassembly 100 has been made up with an upper perforating gun section (not shown), which has been moved into a lubricator above the blowout preventer. The upper perforating gun section with the latch subassembly 100 at the lower end thereof is then lowered through the blowout preventer onto the probe portion 12 of the stinger subassembly 10. The latch subassembly 100 is lowered until the deflecting structure 172 of the spring-loaded housing 108 is stopped by the second shoulder surface 34 above the centralizer surface 36 of the stinger subassembly 10, as shown in FIG. 7.

In this running position illustrated in FIG. 7, the tip 20 of the probe portion 12 of the stinger subassembly 10 is slightly spaced apart from the upper end of the bell-shaped opening 150 formed in the lower body portion 134. In this running position, the finger tip portion 186 of each of the individual collet fingers 182*a* and 182*b* can at least partially begin to be deflected into the recess 28 of the probe portion 12 on the stinger subassembly 10. As can be seen in FIG. 7, the housing spring 168 is trapped in the second annular space 166 defined by the lower body portion 134, the tubular housing member 160, and the flange 164. As previously described, the potential energy of the housing spring 168 is retained by the retaining screws 170 threaded through the tubular housing portion 160 into the collar portion 146 of the lower body portion 134.

At this point, a downward force is applied to the latch subassembly 100. This force is transmitted axially through the latch subassembly 100 to the lower body portion, through the retaining screws 170, through the spring-loaded housing 108 at the deflecting structure 172 to the second shoulder surface 34 above the centralizer surface 36 of the stinger subassembly 10. A sufficiently strong downward force is applied to the latch subassembly that the retaining screws 170 are sheared between tubular housing member 160 and the lower body portion 134. Once the retaining screws 170 have been sheared, the tubular housing member 160 is released from the lower body portion 134. Thus, the housing spring 168, which is trapped between the surface 148 of the collar portion 146 of the lower body portion 134 and the flange 164 of the tubular housing member 160, is now free to drive the slidably mounted tubular housing body 160 upward on the lower body portion 134.

Figure 8:
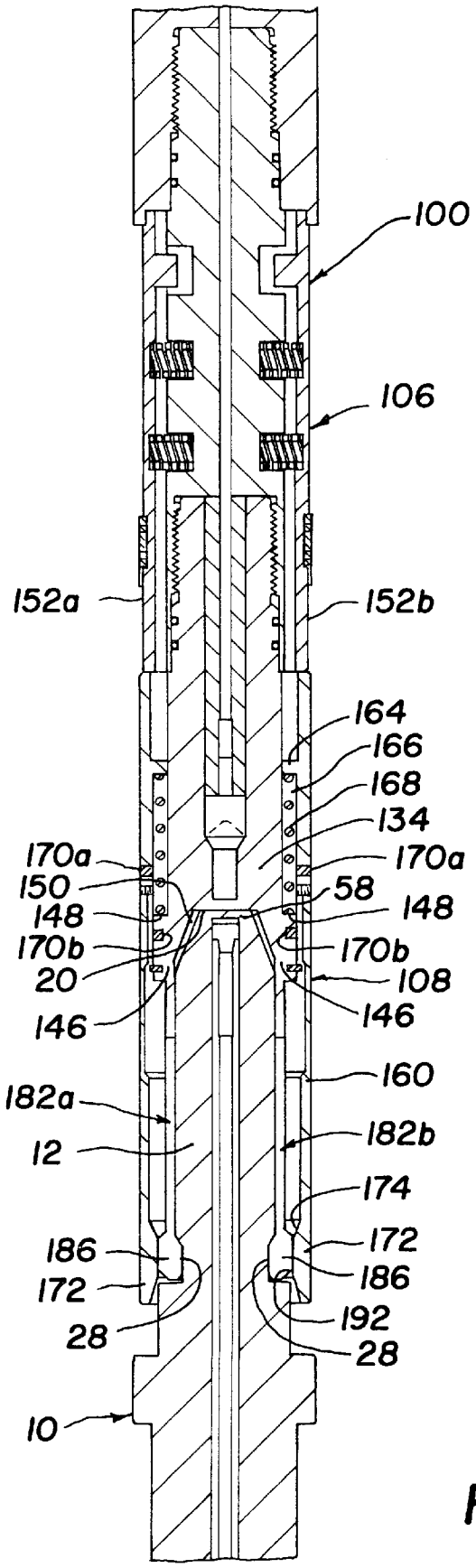
FIG. 8 is an axial cross-section view showing the latch and release subassembly according to FIG. 4 in a latched position on the stinger subassembly according to FIG. 1.

Referring now to FIG. 8 of the drawing, the latch subassembly 100 is shown in a latched position on the stinger subassembly 10. Each of the retaining screws 170 are shown as having been sheared into two portions. An outer portion 170*a* of the sheared retaining screw travels with the upwardly moving tubular housing member 160. An inner portion 170*b* of the sheared retaining screw remains with the collar portion 146 of the lower body portion 134. The upward movement of the tubular housing member 160 on the lower body portion 134 permits the latch subassembly 100 to settle onto the tip 20 of the probe portion 12 of the stinger subassembly 10. Driven by the released housing spring 168, the tubular housing member 160 moves upward on the lower body portion 134 until it is stopped by the pads, such as pads 152*a–b*, of the spring-loaded stop/release pads 106. At this point, the potential energy of the housing spring 168 is only partially released in driving the tubular housing member 160 upward. The upward movement of the tubular housing member 160 also causes the deflecting structure 172 to force and deflect the collet fingers inward. More particularly, the deflecting first ramped surface 174 of the deflecting structure 172 engages the second outwardly facing ramped surface 192 of the finger tip portion 186 inward. Thus, the finger tip portion 186 of each of the collet fingers 182*a* and 182*b* are deflected into the probe recess 28 of the probe portion 12 of the stinger subassembly 10. The various surfaces on the probe portion 12 of the stinger subassembly and the deflecting structure 172 of the tubular housing member cooperate to trap the finger tip portions 186 of the collet fingers 182*a–b* in the probe recess 28. Thus, the latch subassembly 100 is securely latched onto the probe portion 12 of the stinger subassembly. This process of latching the latch subassembly 100 to the stinger subassembly 10 can be accomplished in a matter of seconds.

The stinger subassembly 10 and the latch subassembly 100 form a completed connection between the lower and upper perforating gun sections (not shown). The perforating gun sections can then be lowered downhole to perforate the well.

It is to be understood, of course, that additional perforating gun sections can be successively added to the string using successive additional pairs of stinger subassemblies 10 and latch subassemblies 100.

Furthermore, according to the presently most preferred embodiment of the invention, a detonating signal can be transmitted from the latch subassembly 100 to the stinger subassembly 10. Referring back to FIG. 4 of the drawing, a detonating signal is transmitted from an upper perforating gun to the latch internal explosive transfer system 112 of the latch subassembly 100. The detonating signal from the upper perforating gun detonates the latch receiving booster charge 206. The booster charge 206 in turn ignites the latch detonating cord 208 positioned within the latch internal chamber 200. The latch detonating cord 208 transfers the detonating signal to the latch booster charge 210, which detonates the latch downward focused shaped charge 212. The shaped charge 212 pierces the web material of the lower body portion 134 below the second end 204 of the chamber 200 and fires through the stinger tip web 58 of the stinger subassembly 10 that is latched to the latch subassembly 100.

Referring again to FIG. 8 of the drawing, which shows the latch subassembly 100 in a latched position on the stinger subassembly 10, the tip 20 of the probe 12 of the stinger subassembly 10 is preferably flush with the inner surface of the bell-shaped opening 150 of the lower body portion 134 of the latch subassembly 100. The latch shaped charge 212 pierces through the thickness of the web material 58 defining the tip 20 of the probe portion 12. The latch downward focused shaped charge 212 is adapted to pierce the tip 20 of the subassembly 10. According to the previously described alternative embodiment of the stinger subassembly with respect to FIG. 3 of the drawing, the latch downward focused shape charge 212 pierces the disposable end cap 84.

Referring back to FIG. 1 of the drawing, which shows the stinger subassembly 10 in detail, piercing the web material 58 defining the tip 20 of the probe portion 12 initiates the stinger internal explosive transfer system 18. More particularly, the latch shaped charge 212 pierces the material to initiate the stinger booster charge 60. The stinger booster charge 60 in turn ignites the stinger detonating cord 62 within the stinger internal chamber 52. The stinger detonating cord 62 transfers the detonating signal to the stinger initiator section 64, best shown in FIG. 2. The firing pin 76 mounted within the firing pin housing 66 is fired by the detonating cord 62 toward the stinger initiator 80. According to the invention, the initiator 80 is deformed, but not breached by the firing pin 76, thus, a seal between the interior of the stinger internal chamber 52 and the bell connector portion 16 is maintained. The deforming material of the initiator drives downward to detonate the initiator. This detonation of the initiator initiates a booster charge in a perforating gun section connected to the bell connector portion 16 of stinger subassembly 10. Thus, the detonating signal is transferred from the stinger subassembly 10 to a booster charge and detonating cord in the lower perforating gun section (not shown). The detonating cord in the lower perforating gun section serially detonates the perforating charges in that perforating gun section.

If a plurality of perforating gun sections are connected using the stinger subassembly 10 and latch subassembly 100, the detonating signal is carried through the successive connections as described herein.

After the perforating gun sections have been detonated downhole to perforate the well, they are raised back toward the well head. The second (upper) perforating gun section is raised through the blowout preventer stack until the slip landing portion 14 of the stinger subassembly 10 aligns with the seal/slip rams of the blowout preventer stack. The seal/slip rams of the blowout preventer stack are engaged to seal and hold the perforating gun section string at the stinger subassembly 10. Since the integrity of the stinger subassembly 10 has been maintained, the latch subassembly 100 can be removed from the stinger subassembly 10 without allowing any fluid to escape through the seal/slip rams of the blowout preventer stack.

According to the presently most preferred embodiment of the invention, a clamp or the operating rams of another blowout preventer above the seal/slip rams in the blowout preventer stack are employed to release the latch subassembly 100 from the stinger subassembly 10. As used herein, the term "operating" rams refers to any of a number of different types of rams that are usually employed above the seal/slip rams, except shearing or other type rams that would undesirably damage the latch subassembly. Referring to FIG. 8, the operating rams engage the spring-loaded stop/release pads 106 and radially compress the pads 152*a–b* toward the latch central axis $A_2$. This compressing force opposes the radially outward force of springs 142 and 144 and deflects the pads 152*a–d* inward toward the central body portion 132. Thus, the effective diameter of the spring-loaded stop release pads 106 is reduced. Meanwhile, the tubular housing member 160 is still being acted upon by the housing spring 168 trapped within the second annular space 166. Thus, once the spring-loaded stop release pads 106 are sufficiently compressed, the open end of the tubular housing member 160 can slide upward over the pads 152*a–d*.

Figure 9:
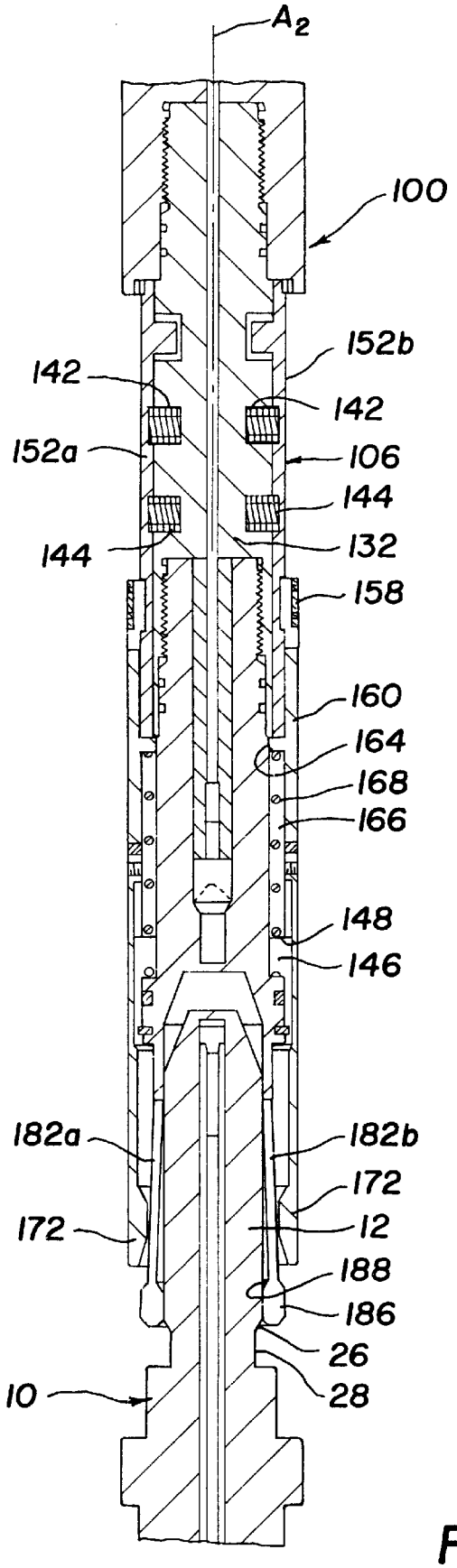
FIG. 9 is an axial cross-section view showing the latch and release subassembly according to FIG. 4 in a released position on the stinger subassembly according to FIG. 1.

Referring now to FIG. 9 of the drawing, the latch subassembly is shown in a released position. The housing spring 168 maintains the tubular housing member 160 over the pads 152*a–d*, which retains them in the reduced diameter form against the opposing forces of the springs 142 and 144 of the spring-loaded latch pads 106. The further upward movement of the tubular housing member 160 also causes the deflecting structure 172 to move upward. This releases the finger pads 186 of the collet fingers 182*a–b*, such that the latch subassembly 100 can be lifted off the probe portion 12 of the stinger subassembly 10. More particularly, as the latch subassembly 100 is lifted upward, the probe second ramp surface 26 deflects the second inwardly facing ramped surface 188 of the finger tip portion 186 of each of the collet fingers 182*a–b*. Thus, the finger tip portion 186 of each of the collet fingers 182*a–b* is deflected out of the probe recess 28 of the probe portion 12 of the stinger subassembly 10. This process of releasing the latch subassembly 100 from the stinger subassembly 10 can be accomplished within a few seconds. Throughout the process, the integrity of the blowout preventer stack pressure seal at the well head can be maintained.

An Example of Latch and Release Gun Connector for Use Through 5-Inch Tubing

Of course, the particular dimensions of the stinger subassembly 10 and latch subassembly 100 according to this invention are a matter of engineering design choice depending on many parameters. Such parameters, include, for example, the particular size of the well tubing and casing in which the stinger subassembly is to be used. The stinger subassembly 10 and latch subassembly 100 can be designed, for example, for use in 5-inch tubing. However, this illustrative example is for the purposes of more fully describing the presently most preferred embodiment of the invention, but not to limit the invention to the particular dimensions of such a disclosed preferred embodiment.

Accordingly, referring back to FIG. 1 of the drawing, the stinger subassembly 10 can have, for example, the following basic dimensions: an overall axial stinger length $L_1$ of about 24 inches (61 cm), an axial probe length $L_2$ of about 10 inches (26 cm); an axial landing length $L_3$ of about 10 inches (26 cm); an axial bell length $L_4$ of about 5 inches (13 cm); a tip diameter $D_1$ of about 1 inches (2.5 cm); a shank diameter $D_2$ of about 2 inches (5 cm); a recess diameter $D_3$ of about 1.5 inches (4 cm); a probe landing diameter $D_4$ of about 2.5 inches (6.5 cm); a centralizer diameter $D_5$ of about 3.5 inches (9 cm); a slip landing diameter $D_6$ of about 3 inches (8 cm); and a bell diameter $D_7$ of about 3.5 inches (9 cm).

Referring again to FIG. 4 of the drawing, the latch subassembly 100 can have, for example, the following basic dimensions: an overall axial latch length $L_5$ of about 30 inches (76 cm); an axial pin length $L_6$ of about 8 inches (20 cm); an axial pads length $L_7$ of about 9 inches (22 cm); an axial spacing length $L_8$ of about 1.2 inches (3 cm); an axial housing length $L_9$ of about 12 inches (30 cm); a pin diameter $D_8$ of about 3.5 inches (9 cm); an overall central body diameter $D_9$ of about 3.2 inches (8 cm); a lower body diameter $D_{10}$ of about 2.2 inches (5.5 cm); an overall pads diameter $D_{11}$ of about 3.2 inches (8 cm); and an overall housing diameter $D_{12}$ of about 3.5 inches (9 cm).

The embodiments shown and described above are only exemplary. For example, the preferred embodiment for the spring-loaded housing is representative of a structure for storing potential energy for moving the housing. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of parts within the principles of the invention to the full extent indicated by the broad and general meaning of the terms used in the attached claims.

The restrictive description and drawings of the specific examples above do not point out what an infringement of this patent would be, but are to provide at least one explanation of how to make and use the inventions. The limit of the inventions and the bounds of the patent protection are measured by and defined in the following claims.

Having described the invention, what is claimed is:

1. A method of releasable connection of first and second tool sections in an assembly for insertion in to a well and thereafter disassembly and removal from the well, the method comprising the steps of:

connecting a stinger to the first tool section;

connecting a stinger receptacle to the second tool section;

latching the stinger to the stinger receptacle to form an assembly by moving an engaging member from a running position to a latched position;

inserting the assembly in a well; and clamping a releasable stop member to move the engaging member out of the latched position such that the stinger and stinger receptacle are axially separable.

2. A method of releasable connection of a first and second tool sections together in an assembly for insertion in to a well and thereafter disassembly and removal from the well, the method comprising the steps of:

connecting a stinger to the first tool section;

connecting a stinger receptacle to the second tool section;

latching the stinger to the stinger receptacle to form an assembly by axially moving an engaging member from a running position to a latched position;

inserting the assembly in a well; and clamping a releasable stop member to permit the engaging member to move from the latched position such that the stinger and stinger receptacle are separable.

3. A method of releasable connection of a first and second tool sections together in an assembly for insertion in to a well and thereafter disassembly and removal from the well, the method comprising the steps of:

connecting a stinger to the first tool section;

connecting a stinger receptacle to the second tool section;

latching the stinger to the stinger receptacle to form an assembly by moving an engaging member from a running position to a latched position;

inserting the assembly in a well; and clamping a releasable stop member to axially move the engaging member with respect to the stop member wherein the engaging member moves axially from the latched position such that the stinger and stinger receptacle are separable.

4. A method of releasable connection of first and second tool sections together in an assembly for insertion in to a well and thereafter disassembly and removal from the well, the method comprising the steps of:

connecting a stinger to the first tool section;

connecting a stinger receptacle to the second tool section;

latching the stinger to the stinger receptacle together to form an assembly by moving an engaging member from a running position to a latched position;

inserting the assembly in a well; and closing a seal ram on the assembly to cause the engaging member to move from the latched position to and unlatched position such that the stinger and stinger receptacle are separable.

5. A method of releasable connection of a first and second tool sections together in an assembly for insertion in to a well and thereafter disassembly and removal from the well, the method comprising the steps of:

connecting a stinger to the first tool section;

connecting a stinger receptacle to the second tool section;

latching the stinger to the stinger receptacle together to form an assembly by moving an engaging member from a running position to a latched position;

closing a seal ram on the assembly to cause the engaging member to move from the latched position to an unlatched position such that the stinger and stinger receptacle are separable;

opening the seal ram; and thereafter axially separating the stinger and stinger receptacle.

6. A method of releasable connection of a stinger on a first tool section to a stinger receptacle on a second tool section to form an assembly for insertion in to a well and thereafter disassembly and removal from the well, the method comprising the steps of:

latching the stinger to the stinger receptacle together to form an assembly;

closing a seal ram on the assembly to cause the engaging member to move from the latched position to an unlatched position such that the stinger and stinger receptacle are separable;

opening the seal ram; and thereafter axially separating the stinger and stinger receptacle.

7. A method of releasable connection of a stinger on a first tool section to a stinger receptacle on a second tool section to form an assembly for insertion in to a well and thereafter disassembly and removal from the well, the method comprising the steps of:

latching the stinger to the stinger receptacle to form an assembly;

closing a seal ram to engage the assembly to cause the engaging member to move from the latched position to an unlatched position such that the stinger and stinger receptacle are separable;

opening the seal ram to disengage the assembly while maintaining the engaging member in the unlatched position; and thereafter axially separating the stinger and stinger receptacle.

8. A method of releasable connection of a stinger on a first tool section to a stinger receptacle on a second tool section to form an assembly for insertion in to a well and thereafter disassembly and removal from the well, the method comprising the steps of:

latching the stinger to the stinger receptacle to form an assembly;

closing a seal ram to engage the assembly to cause the engaging member to axially move from the latched position to an unlatched position such that the stinger and stinger receptacle are separable;

opening the seal ram to disengage the assembly while maintaining the engaging member in the unlatched position; and thereafter axially separating the stinger and stinger receptacle.

9. A method of releasable connection of a stinger on a first tool section to a stinger receptacle on a second tool section to form an assembly for insertion in to a well and thereafter disassembly and removal from the well, the method comprising the steps of:

axially moving the engaging member to latch the stinger to the stinger receptacle to form an assembly;

closing a seal ram to engage the assembly to cause the engaging member to move from the latched position to an unlatched position such that the stinger and stinger receptacle are separable;

opening the seal ram to disengage the assembly while maintaining the engaging member in the unlatched position; and thereafter axially separating the stinger and stinger receptacle.

10. A method of releasable connection of a stinger on a first tool section to a stinger receptacle on a second tool section to form an assembly for insertion in to a well having a blow out preventer and thereafter disassembly and removal from the well, the method comprising the steps of:

latching the stinger to the stinger receptacle together to form an assembly;

positioning the latched stinger and stinger receptacle into the well;

moving the latched stringer and stinger receptacle into the seal ram of the blow out preventer;

closing a seal ram to engage the assembly to cause the engaging member to move from the latched position to an unlatched position such that the stinger and stinger receptacle are separable;

opening the seal ram to disengage the assembly while maintaining the engaging member in the unlatched position; and thereafter axially separating the stinger and stinger receptacle without substantial rotation between said stinger and stinger receptacle.

11. A method of releasable connection of a stinger on a first tool section to a stinger receptacle on a second tool section to form an assembly for insertion in to a well having a blow out preventer and thereafter disassembly and removal from the well, the method comprising the steps of:

axially moving the engaging member to latch the stinger to the stinger receptacle together to form an assembly;

positioning the latched stinger and stinger receptacle into the well;

moving the latched stringer and stinger receptacle into the seal ram of the blow out preventer;

closing a seal ram to engage the assembly to cause the engaging member to move from the latched position to an unlatched position such that the stinger and stinger receptacle are separable;

opening the seal ram to disengage the assembly while maintaining the engaging member in the unlatched position; and thereafter axially separating the stinger and stinger receptacle without substantial rotation between said stinger and stinger receptacle.

12. A method of releasable connection of a stinger on a first tool section to a stinger receptacle on a second tool section to form an assembly for insertion in to a well having a blow out preventer and thereafter disassembly and removal from the well, the method comprising the steps of:

latching the stinger to the stinger receptacle together to form an assembly;

positioning the latched stinger and stinger receptacle into the well;

moving the latched stringer and stinger receptacle into the seal ram of the blow out preventer;

closing a seal ram to engage the assembly to cause the engaging member to axially move from the latched position to an unlatched position such that the stinger and stinger receptacle are separable;

opening the seal ram to disengage the assembly while maintaining the engaging member in the unlatched position; and thereafter axially separating the stinger and stinger receptacle without substantial rotation between said stinger and stinger receptacle.

13. A method of releasable connection of a stinger on a first tool section to a stinger receptacle on a second tool section to form an assembly for insertion in to a well having a blow out preventer and thereafter disassembly and removal from the well, the method comprising the steps of:

latching the stinger to the stinger receptacle to form an assembly;

positioning the latched stinger and stinger receptacle into the well;

axially moving the latched stringer and stinger receptacle into the seal ram of the blow out preventer without rotating the assembly;

closing seal ram to engage the assembly to cause the engaging member to move from the latched position to an unlatched position such that the stinger and stinger receptacle are separable;

opening the seal ram to disengage the assembly while maintaining the engaging member in the unlatched position; and thereafter axially separating the stinger and stinger receptacle.

14. A method of releasable connection of a stinger on a first tool section to a stinger receptacle on a second tool section to form an assembly for insertion in to a well having a blow out preventer and thereafter disassembly and removal from the well, the method comprising the steps of:

axially moving the engaging member to latch the stinger to the stinger receptacle to form an assembly;

positioning the latched stinger and stinger receptacle into the well;

axially moving the latched stringer and stinger receptacle into the seal ram of the blow out preventer without rotating the assembly;

closing seal ram to engage the assembly to cause the engaging member to move from the latched position to an unlatched position such that the stinger and stinger receptacle are separable;

opening the seal ram to disengage the assembly while maintaining the engaging member in the unlatched position; and thereafter axially separating the stinger and stinger receptacle.

15. A method of releasable connection of a stinger on a first tool section to a stinger receptacle on a second tool section to form an assembly for insertion in to a well having a blow out preventer and thereafter disassembly and removal from the well, the method comprising the steps of:

latching the stinger to the stinger receptacle to form an assembly;

positioning the latched stinger and stinger receptacle into the well;

axially moving the latched stringer and stinger receptacle into the seal ram of the blow out preventer without rotating the assembly;

closing seal ram to engage the assembly to cause the engaging member to axially move from the latched position to an unlatched position such that the stinger and stinger receptacle are separable;

opening the seal ram to disengage the assembly while maintaining the engaging member in the unlatched position; and thereafter axially separating the stinger and stinger receptacle.

16. A method of releasable connection of a stinger on a first tool section to a stinger receptacle on a second tool section to form an assembly for insertion in to a well having a blow out preventer and thereafter disassembly and removal from the well, the method comprising the steps of:

latching the stinger to the stinger receptacle to form an assembly;

positioning the latched stinger and stinger receptacle into the well;

axially moving the latched stringer and stinger receptacle into the seal ram of the blow out preventer without rotating the assembly;

closing a seal ram to constrict around the periphery of at least a portion of the assembly to cause the engaging member to move from the latched position to an unlatched position such that the stinger and stinger receptacle are separable;

opening the seal ram to disengage the assembly while maintaining the engaging member in the unlatched position; and axially separating the stinger and stinger receptacle.

17. A method of releasable connection of a stinger on a first tool section to a stinger receptacle on a second tool section to form an assembly for insertion in to a well having a blow out preventer and thereafter disassembly and removal from the well, the method comprising the steps of:

positioning the first and second tool sections in the well;

thereafter latching the stinger to the stinger receptacle to form an assembly for use in the well;

axially moving the latched stringer and stinger receptacle into the seal ram of the blow out preventer;

closing the seal ram on least a portion of the assembly while preventing relative movement between the tool sections to cause the engaging member to move from the latched position to an unlatched position such that the stinger and stinger receptacle are separable;

opening the seal ram to disengage the ram from the assembly while maintaining the engaging member in the unlatched position; and axially separating the stinger and stinger receptacle.

18. The method of claims 1, 2, 3, 4, 5, 6, 7, 8, 9, 10, 11, 12, 13, 14, 15, 16, or 17 additionally comprising the step of retaining the engaging member in the running position with a frangible member and causing the frangible member to fail to move to the latched position.

19. The method of claim 18 wherein the frangible member is a shear pin.

20. The method of claims 1, 4, 5, 6, 7, 10, or 14 wherein the step of moving the engaging member comprises moving the engaging member in an axial direction.

21. The method of claims 1, 2, or 3 wherein the clamping step comprises closing a seal ram to contact the stop member and cause the engaging member to move from the latched position while maintaining the relative axial position of the stinger and stinger receptacle.

22. The method of claims 1, 2, 3, 4, 5, or 6 wherein the step of clamping to disengage additionally comprises the step of retaining the engaging member out of the latched position.

23. An apparatus for releasably connecting a first tool section to a second tool section to form an assembly for use in to a well and for disassembly by use of a seal ram, comprising:

first and second tool sections;

a stinger on one of the tool sections and a mating stinger receptacle on the other of the tool sections;

an engaging member mounted on at least one of the stinger and stinger receptacle; the engaging member mounted to move axially between a running position, a latched position, and an unlatched position;

the engaging member being mounted so that when in the running position the engaging member will move axially to the latched position upon axial movement of the stinger into engagement with the stinger receptacle;

the engaging member being mounted so that when in the latched position the stinger and stinger receptacle are connected together for use in a well and upon engagement by a seal ram will move to a unlatched position; and the engaging member being mounted so that when in the unlatched position the stinger and stinger receptacle are axially separable.

24. An apparatus for releasably connecting a first tool section to a second tool section to form an assembly for use in to a well, comprising first and second tool sections;

a stinger on one of said tool sections and a mating stinger receptacle on the other of the tool sections;

an engaging member mounted on at least one of said stinger and stinger receptacle; the engaging member mounted to move axially between a running position, a latched position, and an unlatched position;

the engaging member being mounted so that when in the running position the engaging member will move axially to the latched position upon axial movement of the stinger into engagement with the stinger receptacle;

the engaging member being mounted so that when in the latched position the stinger and stinger receptacle are connected together for use in a well and upon engagement of a releasable stop member by a seal ram will move axially with respect to the stop member to a unlatched position; and the engaging member being mounted so that when in the unlatched position the stinger and stinger receptacle are axially separable.

25. The apparatus of claims 23 or 24 wherein the engaging member is a sleeve.

26. The apparatus of claims 23 or 24 wherein the engaging member is a sleeve and is mounted on the stinger receptacle.

27. The apparatus of claims 23 or 24 additionally comprising a releasable stop member mounted to the one of said tool sections to selectively contact the engaging member and stop the axial movement of the engaging member in the latched position.

28. The apparatus of claims 23 or 24 wherein the stop member is radially movable to release the engaging member to the engaging member to move to the unlatched position.

29. The apparatus of claims 23 or 24 additionally comprising a resilient member on the at least one tool section to contact and resiliently urge the engaging member urged to move in a direction from the latched position to the unlatched position.

30. The apparatus of claims 23 or 24 additionally comprising a shear pin mounted to retain the engaging member in the running position.

31. The apparatus of claims 23 or 24 wherein the stinger and stinger receptacle are cylindrical shaped and the engaging member is a cylindrical sleeve with an external surface equal no greater in diameter than the external surface external diameter of the stinger and sleeve.

32. The apparatus of claims 23 or 24 wherein the stop member has a semicylindrical external surface with an external diameter no greater in diameter than the external surface of the engaging member.

* * * * *